United States Patent [19]

Johnson, Jr.

[11] 4,289,479

[45] Sep. 15, 1981

[54] THERMALLY INSULATED ROTARY KILN AND METHOD OF MAKING SAME

[76] Inventor: Allen S. Johnson, Jr., P.O. Drawer 1037, Salisbury, N.C. 28144

[21] Appl. No.: 160,989

[22] Filed: Jun. 19, 1980

[51] Int. Cl.[3] ..... F27B 7/28; F27D 1/16

[52] U.S. Cl. ..... 432/3; 432/119; 110/336

[58] Field of Search ..... 432/103, 118, 119, 105, 432/3; 110/246, 336; 52/612

[56] References Cited

U.S. PATENT DOCUMENTS

| | | | |
|---|---|---|---|
| 2,111,783 | 3/1938 | Hults | 432/118 |
| 2,137,184 | 11/1938 | Seil | 432/119 |
| 2,321,813 | 6/1943 | Henzel | 52/612 |
| 2,341,777 | 2/1944 | Hensel | 52/612 |
| 3,445,099 | 5/1969 | Olsen et al. | 110/246 |
| 3,994,669 | 11/1976 | Meenan | 110/336 |
| 4,122,642 | 10/1978 | Buchy | 110/336 |

*Primary Examiner*—Henry C. Yuen

*Attorney, Agent, or Firm*—Bell, Seltzer, Park & Gibson

[57] ABSTRACT

A wear-resistant, thermal protective, annular liner for a rotary kiln and an attendant method of making the same. The liner includes a series of elongate, axially aligned, annular composite liner sections, each of which comprises a layer of lightweight insulation material formed by side-by-side longitudinal rows of thermal insulating blocks positioned against the interior surface of the metal cylindrical wall of the kiln, with anchor brackets secured to the kiln wall and extending through respective openings in the insulating blocks and embedded in a relatively thicker and heavier layer of refractory material overlying the layer of insulation material, and wherein column portions of the refractory material project inwardly from the layer of refractory material and through the openings in the insulating blocks and in surrounding relation to the inner portions of the anchor brackets for supporting the layer of refractory material and preventing crushing the insulation material.

The method includes the forming of each of the annular liner sections in successive segments while periodically rotating the cylindrical wall of the kiln so that each successive segment may be supported upon a successive lower region of the kiln wall interior surface while the respective segment is being constructed.

22 Claims, 11 Drawing Figures

THERMALLY INSULATED ROTARY KILN AND METHOD OF MAKING SAME

This invention relates to rotary kilns and more particularly to a rotary kiln construction and attendant method so as to effectively avoid heretofore large heat losses through the wall of the kiln.

Until recent years, most rotary kiln operators have not been seriously concerned with heat losses through the wall of the kiln since energy costs were a relatively small factor in the overall cost of operation. However, recent years have caused all businesses that utilize large amounts of heat energy to give serious attention to any possible waste or loss thereof. Today, in the rotary kiln field wherein necessarily high temperatures are utilized for effecting the desired processing of the ore or aggregate material, relatively large energy requirements are a very significant factor in the overall cost of operation.

Accordingly, it is the primary object of this invention to provide a wear-resistant thermal protective liner for a rotary kiln and associated method of forming the same for effectively thermally insulating the rotary kiln to drastically reduce the energy requirements by substantially eliminating any appreciable amount of heat loss through the wall of the rotary kiln. The method of this invention results in a thermal liner being provided throughout substantially the entire length of the kiln and wherein the liner is constructed of a layer of thermal insulation material against the inner wall of the kiln and wherein a layer of hard cast refractory material overlies the layer of insulation material with suitable anchor brackets extending through the thermal insulation material and being substantially embedded in the overlying layer of hard cast refractory material for serving to enhance the wear-resistant nature of the layer of refractory material.

A more specific object of this invention is to provide a wear-resistant, thermal protective liner for a rotary kiln and attendant method of forming the same wherein the liner comprises a layer of lightweight thermal insulation material positioned against the interior of the kiln wall and is formed from a plurality of lightweight thermal insulating blocks having openings through medial portions thereof through which anchor brackets extend that are suitably secured, as by welding, to the inner wall of the kiln. A layer of relatively thicker and heavier hard cast refractory material is provided which overlies the layer of insulation material formed of the insulating blocks, with the layer of refractory material having a plurality of spaced-apart column portions of the refractory material projecting iwardly from the refractory material layer and through the openings in the insulating blocks. The refractory material substantially embeddingly surrounds the anchor brackets so that the anchor brackets in turn reinforce the column portions of the refractory material and the column portions of the refractory material then serve for supporting the entire layer of the refractory material to prevent crushing the underlying layer of thermal insulating material.

Some of the objects and advantages of the invention having been stated, others will appear as the description proceeds when taken in connection with the accompanying drawings in which—

DETAILED DESCRIPTION

Figure 1:
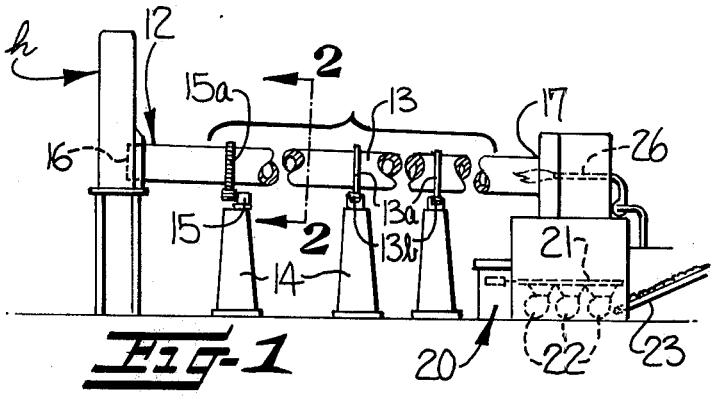
FIG. 1 is a schematic elevational view of an aggregate processing apparatus including a rotary kiln constructed in accordance with the present invention.

Referring more specifically to the drawings, the numeral 12 broadly designates a rotary kiln which is part of an apparatus for processing and heat treating aggregate and which includes an elongate tubular body or cylindrical metal kiln wall 13 suitably mounted for rotation about its generally horizontal longitudinal axis on supporting standards or posts 14. Conventionally, so-called "tires" **13*a*, in the form of steel hoops, engagingly surround the kiln wall 13 and rotate upon rollers 13*b* carried by several of the standards 14 for rotatably supporting the kiln wall 13 thereon. A drive motor 15 is suitably connected to the kiln wall 13, as by means of a ring gear 15*a* encircling the kiln wall 13, for imparting rotation thereto. The minerals or other materials to be processed through the illustrated apparatus of FIG. 1** are referred to herein by the term "aggregate," but it is to be understood that this term is not intended to be limited to a mineral or rock of any particular chemical composition.

Typically, aggregate to be processed is directed into the open aggregate-receiving end (the left-hand end in FIGS. 1 and 4) of the kiln 12 via a preheater h of conventional or other construction into which the aggregate is suitably conveyed from a suitable source, not shown. The cylindrical kiln wall 13 is oriented on a gradual downward incline, as is conventional, so that rotation of the kiln wall 13 will gradually advance the aggregate from the open aggregate-receiving end 16 of the kiln wall 13 longitudinally through the same to be discharged through the open discharge end 17 of the cylindrical kiln wall 13. Conventionally, the aggregate is heated to a desired temperature as it is being advanced along within the cylindrical kiln wall 13, and the heated aggregate discharged from the kiln wall 13 is deposited in an aggregate cooler generally designated at 20. The cooler 20 may be of a well-known type including a grate 21 on which the heated aggregate is deposited, and a plurality of fans 22 for directing air upwardly through the grate 21 and into contact with the heated aggregate for cooling the same. The thus cooled aggregate is removed from the grate 21 and deposited on a suitable conveyor 23 which conveys the aggregate elsewhere for storage or subsequent processing.

The air which passes through the aggregate in the cooler 20 is heated by the aggregate and is directed from the cooler 20 into the discharge end 17 of the elongate rotary kiln 12. The kiln 12 includes a combustion chamber, to be later described, located adjacent its discharge end 17 and within which a flame is directed by a suitable burner 26 for thus heating the aggregate contained in the kiln to a desired temperature. The heated air from the fans 22 and the combustion gases from the burner 26 travel longitudinally through the cylindrical wall 13 of the kiln 12 in a direction countercurrent to the direction of the aggregate therethrough and are discharged from the opposite or aggregate-receiving end of the kiln into the preheater h where the heated gases are discharged from the apparatus, as is well known.

As is well known in the art, conventional rotary kilns are in the form of long refractory-lined cylinders of the general type heretofore described with reference to FIG. 1, and they are one of the largest type of kilns used in the industry. Conventional rotary kilns may be up to about twelve feet (3.66 meters) or more in diameter and up to about five hundred feet (153 meters) or more in length. Some rotary kilns are used for heat treating loose bulk materials such as lime and cement, and others are used for heat treating or roasting relatively coarse chunks of a size up to about two to three inches (50.8 to 76.2 mm) across as distinguished from fine granular or powdered material of a size comparable to sand, for example.

In the heat treating of aggregate in a conventional type of rotary kiln whose interior refractory liner was not thermally insulated from the cylindrical metal wall of the kiln, considerable heat was lost through the refractory liner and the kiln wall, thus wasting substantial amounts of energy. Also, when heat treating coarse aggregate in particular, it was found that the abrasion of the aggregate rubbing against the refractory liner of the rotary kiln would cut into and oftentimes break away large chunks of the refractory liner, thus resulting in further heat losses through the metal kiln wall and also damaging the kiln wall.

In this regard, an exemplary conventional kiln with a cylindrical metal wall of about eleven feet (3.35 meters) in diameter and about one hundred sixty-five feet (50.29 meters) long was used for heat treating aggregate in a size range of about three-fourths inch to one and one-half inches (19 to 38 mm) across. The temperature at the burner end of the kiln was about 2300° F. (1260° C.) with the heated gases being discharged from the opposite or aggregate-receiving end of the kiln at about 1050° to 1250° F. (565.6° to 676.7° C.). Thus, it can be appreciated that the kiln metal wall might become extremely hot at the location of a hole in the refractory liner. The heat lost through the refractory-lined kiln wall of the aforementioned exemplary conventional kiln also was of such extent that, upon at least one occasion of a rain shower on the rotary kiln, the kiln became so distorted or warped along its length that its supporting tires and rollers, such as those tires 13*a* and rollers 13*b* of FIG. 1, were misaligned, thus preventing its drive motor from rotating the rotary kiln.

Figure 4:
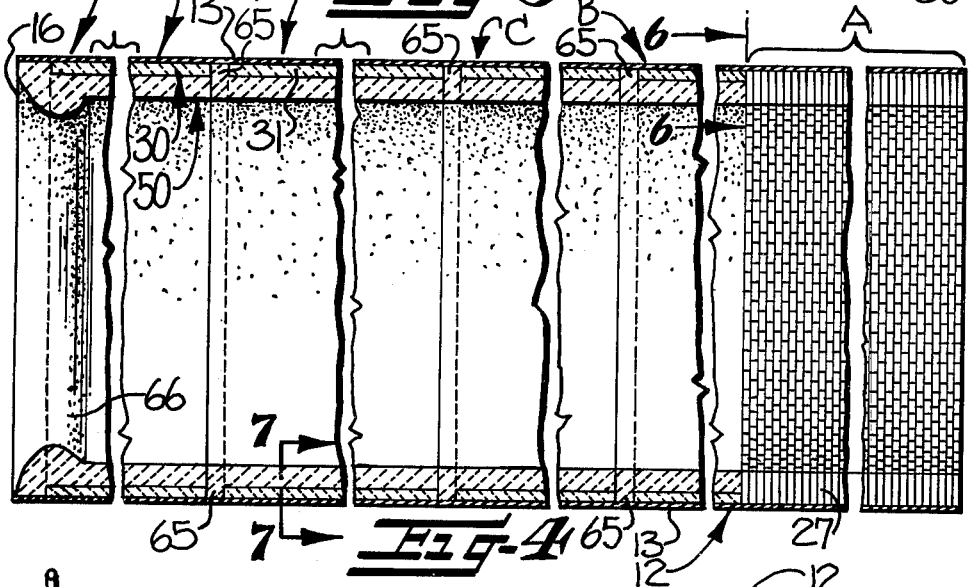
FIG. 4 is a longitudinal sectional view through the cylindrical body of the rotary kiln of FIG. 1, taken substantially along line 4—4 in FIG. 2, with portions thereof broken away and other portions thereof omitted for the purpose of clarity.

Therefore, in order to reduce heat losses through the metal kiln wall 13 and provide a durable refractory surface to the kiln wall 13, according to the preferred embodiment of this invention, an improved wear-resistant, thermal protective, annular liner is provided extending around the interior surface of the metal kiln wall 13. As best shown in FIG. 4, the annular liner may be formed as a longitudinal series of elongate, axially aligned, annular liner sections A–E, the liner section A being formed of refractory brick only and defining a combustion chamber, and the liner sections B–E each being a composite liner section formed of a layer of thermal insulation material underlying a layer of refractory material, as will be presently described. The combustion chamber liner section A is located adjacent the open aggregate-discharge end 17 of the rotary kiln 12 into which the flame from the burner 26 is directed, and the composite liner sections B–E extend from the combustion chamber liner section A to the open aggregate-receiving end 16 of the rotary kiln 12.

Figure 6:
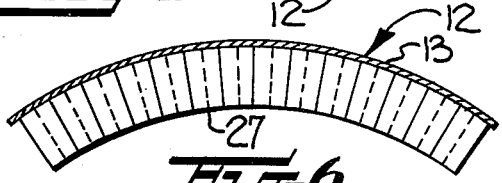
FIG. 6 is a fragmentary view of the inner end of the annular liner section of a combustion chamber, taken substantially along line 6—6 in FIG. 4.
Figures 8, 9, 10:
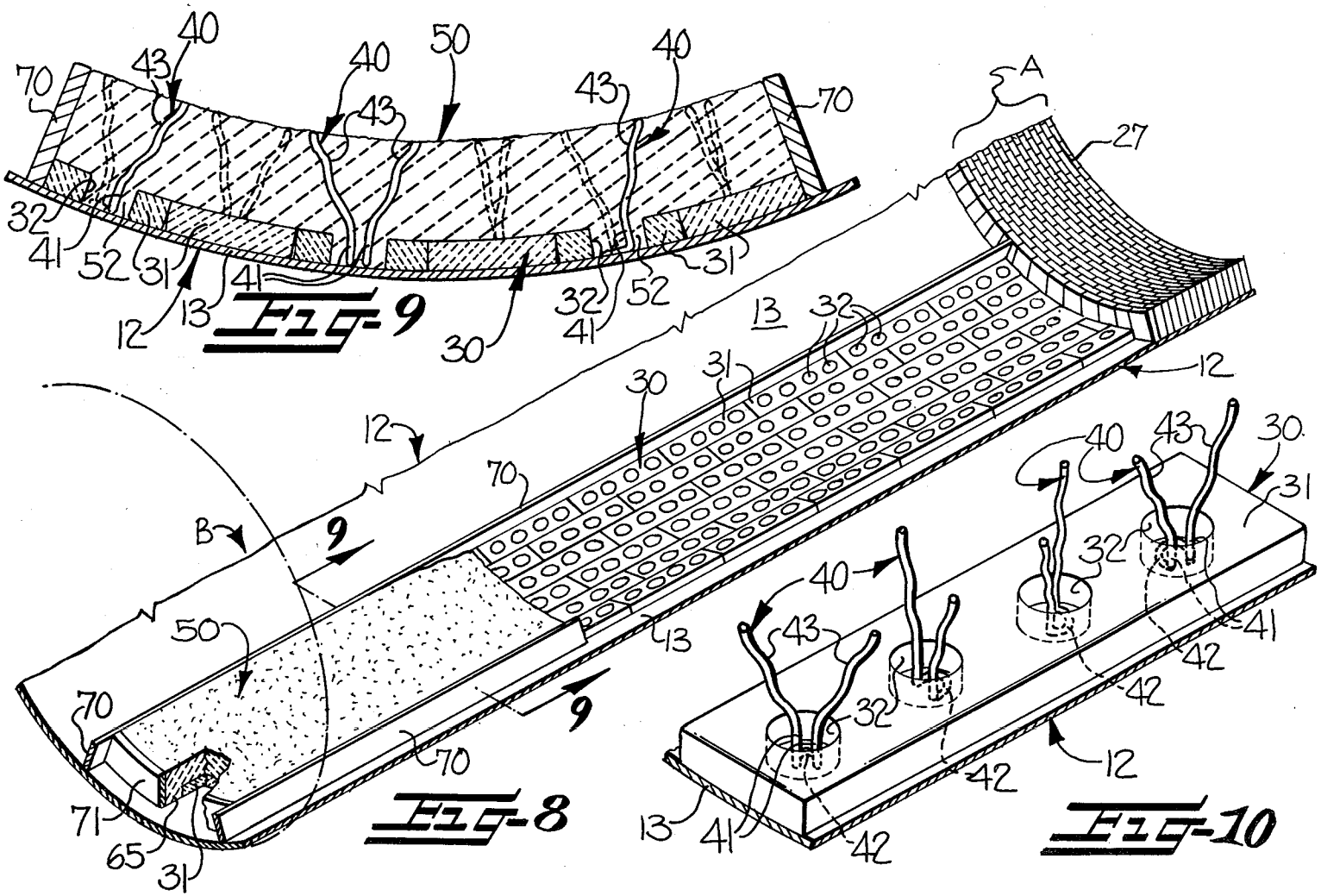
FIG. 8 is a fragmentary, partially schematic perspective view illustrating how a segment of the corresponding annular liner section may be constructed in accordance with the method of this invention.
FIG. 9 is an enlarged fragmentary sectional view taken substantially along line 9—9 in FIG. 8.
FIG. 10 is a fragmentary view showing one of the thermal insulating blocks positioned against the kiln wall interior surface, with anchor brackets secured to the kiln wall and projecting outwardly through openings in the insulating block.

As shown in FIGS. 4, 6 and 8, the combustion chamber liner section A is formed of an annular layer 27 of refractory brick positioned against and extending around the interior surface of the kiln wall 13 and being of an axial length sufficient to define the desired length of the combustion chamber. It is preferred that the brick in the layer 27 are arranged in annular rows with the adjacent brick being staggered in adjacent annular rows. Further details of the combustion chamber liner section A will appear later in this context.

Since all the composite annular liner sections B–E are of substantially the same construction, only the composite liner section B will be described in detail. Accordingly, it will be observed in FIGS. 2 and 4 that the wear-resistant, thermal protective, annular liner B there shown comprises an annular layer 30 of thermal insulation material positioned against the interior surface of the kiln wall 13 and being made up of a plurality of contiguous lightweight thermal insulating blocks 31 having openings 32 through medial portions thereof extending generally perpendicular to the kiln wall 13 so as to provide openings throughout the layer of thermal insulation material 30.

As best shown in FIGS. 3, 8, 10 and 11, each insulating block 31 is preferably of elongate, relatively thin, substantially rectangular configuration. For example, in a prototype rotary kiln provided with a liner constructed in accordance with this invention, the insulating blocks used were each about nine inches wide by thirty-six inches long by two inches thick (22.86 cm×91.44 cm×5.08 cm). Each insulating block should be made of a lightweight, compacted, fibrous insulation material having a low thermal conductivity factor, such as silica.

As shown, each full-length insulating block 31 has a longitudinal row of four circular openings 32 therethrough which are preferably uniformly spaced apart substantially along the longitudinal center of the insulating block with the centers of the two endmost openings 32 being spaced from the respective opposite ends of the block a distance about equal to one-half that of the distance between the centers of any two adjacent openings 32. For example, a full-length insulating block 31 of the size mentioned above had four openings 32 therethrough, each of which was about three and one-half to four inches (8.9 to 10.16 cm) in diameter with the center-to-center distance between the openings 32 being about nine inches (22.86 cm) and the distance from each end of the block to the center of the respective endmost opening 32 being about four and one-half inches (11.43 cm).

Figure 3:
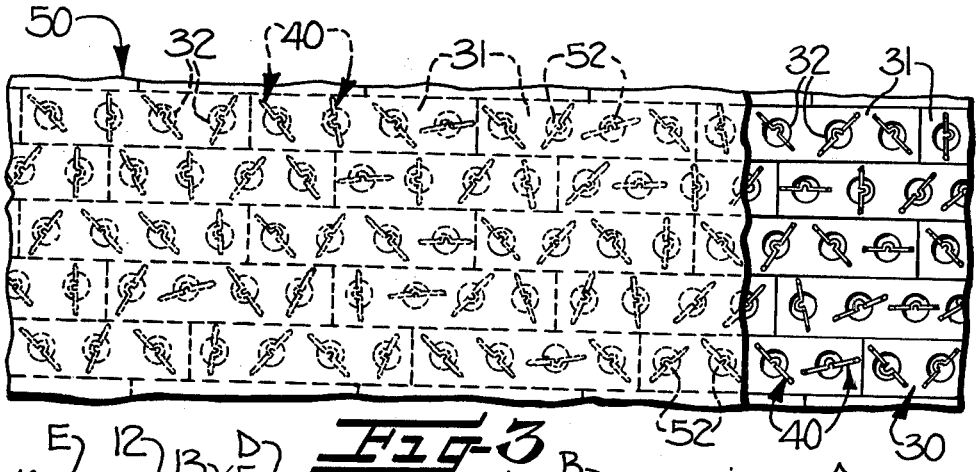
FIG. 3 is a fragmentary elevational view of a portion of the improved interior annular liner of the rotary kiln as constructed in accordance with the present invention and being taken looking generally along line 3—3 in FIG. 2.
Figure 11:
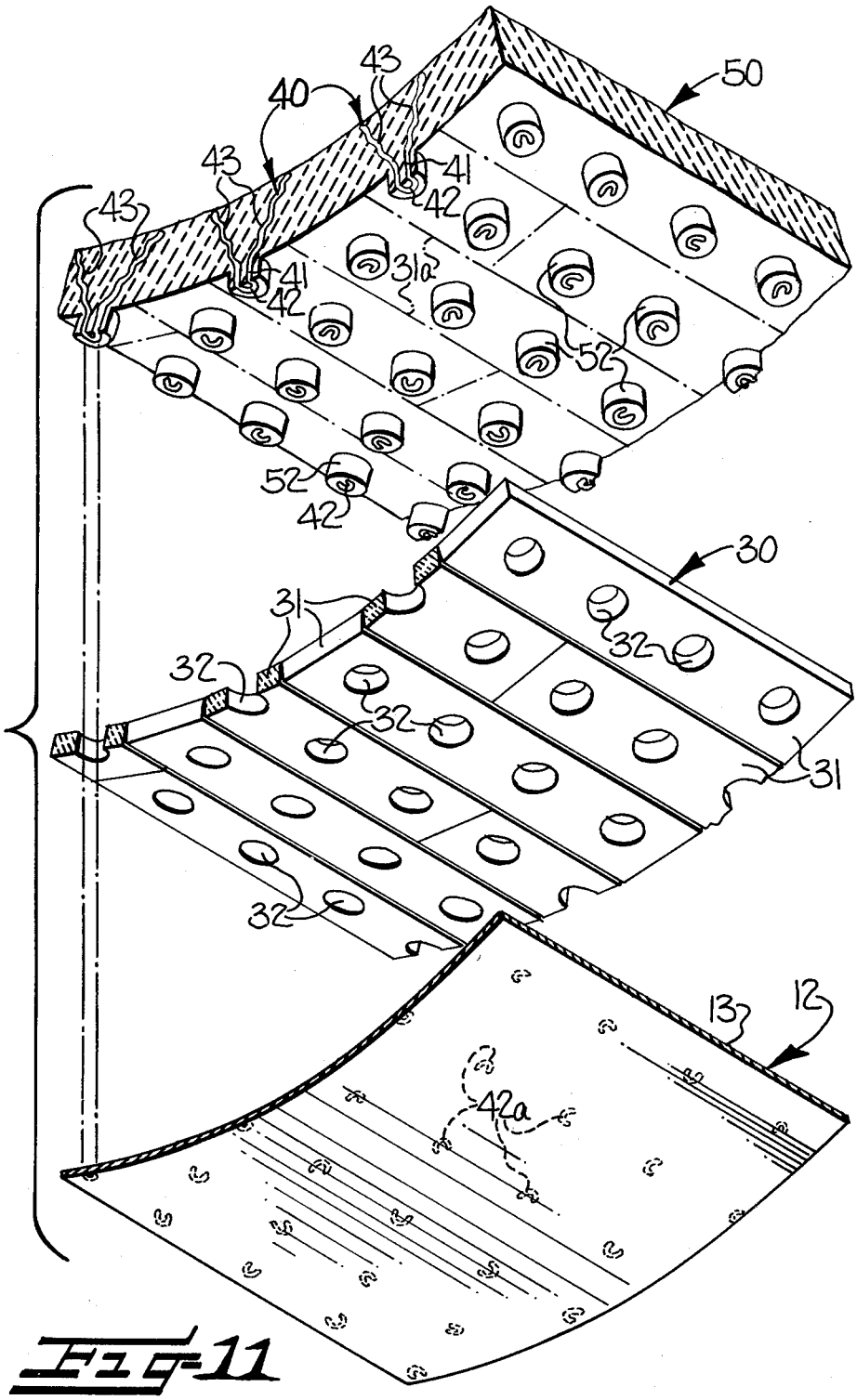
FIG. 11 is an exploded, fragmentary, perspective view of a segment of one of the improved liner sections for the kiln wall.

As best shown in FIGS. 3, 8 and 11, the insulating blocks 31 in each respective liner section formed therefrom are positioned in end-to-end relationship in longitudinally extending side-by-side rows, with the abutting ends of adjacent blocks 31 in each row being longitudinally offset with respect to the abutting ends of adjacent blocks 31 in the immediately adjacent longitudinal row. Thus, the seams or cracks defined at the juncture of the proximal ends of adjacent blocks 31 in adjacent rows are offset and are thus discontinuous around the interior of the kiln wall 13. More importantly, the openings 31 in the blocks of adjacent rows are offset from each other as opposed to being aligned around the interior of the kiln 12 so as to reduce the likelihood of cracks or fissures being formed in the cast refractory material overlying the layer 30 of insulation material formed of the insulating blocks 31, which refractory material will be presently described.

It is apparent that, with the insulating blocks 31 positioned against the interior surface of the kiln wall 13, since the openings 32 extend transversely through medial portions of the insulating blocks 31, portions of the interior surface of the kiln wall 13 are visible through the openings 32. Thus, after a desired number of the insulating blocks 31 are positioned against the interior surface of kiln wall 13, the inner end portions or leg portions 41 of anchor brackets, broadly designated at 40, are inserted through the respective openings 32 in the insulation material layer 30 and are welded or otherwise suitably secured to the interior surface of the kiln wall 13.

Figure 5:
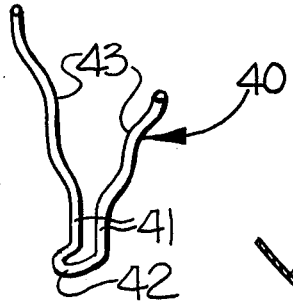
FIG. 5 is an enlarged perspective view of a preferred form of one of the anchor brackets employed for reinforcing the layer of refractory material and firmly anchoring both the layer of insulation material and the overlying layer of refractory material of FIGS. 2 and 3 to the metal kiln wall.

The length or height of the anchor brackets is such that they project outwardly through the openings 32 and beyond the insulating blocks 31, with the orientation of the brackets being random so that arm portions 43 thereof extend in a random pattern (see FIG. 3). More specifically, it will be observed in FIGS. 5, 9 and 10 that each anchor bracket 40 may be made of steel rod of about one-fourth inch (6.35 mm) diameter, and the inner end portion 41 of each anchor bracket 40 may take the form of a pair of generally parallel leg portions whose innermost ends are joined by a substantially U-shaped laterally extending foot portion 42 integral therewith. Also, the inner end portion 41 has a pair of the arm portions 43 thereon which extend in diverging relation and project outwardly beyond the respective insulating block 31. To lend strength and stability to the outer arm portions 43, each of them preferably is of a substantially serpentine configuration, as shown.

After anchor brackets 40 have been secured to the interior surface of the kiln wall 13 with their inner end portions projecting through the openings 32 throughout a respective layer or respective segment of the respective layer 30 of insulation material (see FIGS. 3, 9 and 10), a layer 50 of relatively hard cast refractory material is formed to overlie the layer 30 of insulation material. The refractory material layer 50 is relatively thicker (see FIGS. 2, 4, 7, 9 and 11) and heavier than the insulation material layer 30 and is provided with a plurality of spaced-apart column portions 52 (FIG. 11) formed of the refractory material and projecting inwardly from the layer 50 and through the openings 32 in the thermal insulation material layer 30 and positioned against the interior surface of the kiln wall so that the cast refractory material is essentially supported by the column portions 52 thereof engaging the kiln wall 13 to prevent crushing the underlying layer 30 of insulation material. The thickness of the refractory material layer 50 over the insulation material layer 30 preferably is about seven inches (17.78 cm) or more, and should be no less than about six inches (15.24 cm).

To clearly illustrate the preferred relationship between the various components of the liner section heretofore described, a few of the anchor brackets 40 are shown embedded in the refractory material layer 50 and its column portions 52 in the upper portion of FIG. 11, with the column portions of the layer 50 being shown in exploded relation to the corresponding insulating blocks 31 and the openings 32 therein, and with the positions which would otherwise be occupied by the looped or substantially U-shaped lower end foot portions 42 of the anchor brackets 40 being shown in phantom lines indicated at **42*a* representing the position they would occupy against the interior surface of the kiln wall 13. The phantom lines 31*a* in the upper portion of FIG. 10 represent the outlines of the insulating blocks 31 to illustrate the position they would occupy relative to the refractory material layer 50 were the kiln wall 13 and the layers 30, 50 not shown in exploded relationship in FIG. 11. From the foregoing description, it is apparent that the anchor brackets 40 are secured to the interior surface of the kiln wall 13 and project outwardly through the column portions 52 and into the layer 50 of cast refractory material so that the column portions 52 are in surrounding relation to the respective anchor brackets and so that the anchor brackets reinforce the layer 50 of refractory material and also firmly anchor both the layer 30 of insulation material and the layer 50 of refractory material to the kiln wall 13. It is to be noted that the outer arm portions 43 of the anchor brackets 40 in FIGS. 2, 5, 9 and 10 project outwardly beyond the respective thermal insulating blocks 31 to such extent that they are exposed at the outer surface of the respective layer 50** of refractory material for presenting a more wear-resistant surface to the refractory material.

Due to the mechanically severe conditions and the abrasion of the aggregate against the liner within the rotary kiln 12, there is a possibility that the refractory material 50 of a composite liner section may fracture or rupture to an extent such that the high temperature gases in the kiln might cause the adjacent area of the thermal insulation material layer 30 to burn or melt. Since such burning or melting of the insulation material will likely spread through such material, it can be appreciated that it is highly desirable to provide means for restricting such spreading of the burning or melting condition. Thus, not only is that portion of the kiln interior liner extending from the inner end of the combustion chamber A to the open aggregate-receiving end 16 of the rotary kiln divided into the series of elongate relatively short composite liner sections B–E heretofore described, but it is desirable to also provide an optional annular fire barrier wall 65 of cast refractory material positioned against and extending around the interior surface of the kiln wall 13, between and connected to the proximal ends of each adjacent pair of the composite liner sections.

As shown in FIG. 4, each annular fire barrier wall 65 is formed integrally with the cast refractory material of a respective adjacent composite liner section and is cast of the same refractory material as that of the cast layer 50 overlying the insulating blocks 31. The height of each fire barrier wall 65 and the height of the brick in the layer 27 forming the combustion chamber liner section A is such that the thickness of each fire barrier wall 65 and the refractory brick layer 27 is about equal to the combined thickness of the adjacent layers 30, 50 of insulation material and refractory material of each composite liner section B–E, i.e., about eight to ten inches (20.32 to 25.4 cm) thick.

As the aggregate passes into the rotary kiln from the preheater h (FIG. 1), the aggregate may tend to spill out of the kiln 12. Accordingly, to aid in preventing the aggregate from spilling out of the open aggregate-receiving end 16 of the rotary kiln 12 during rotation thereof, it is preferred that an annular retaining ridge 66 is formed of the refractory material and integral with the refractory material layer 50 of the respective end-most composite liner section E for defining the opening in the aggregate receiving end 16 of the rotary kiln 12.

According to the preferred method of constructing the annular liner on and around the interior surface of the kiln metal wall 13, the combustion chamber liner section A and/or each fire barrier wall 65 may be constructed at any time, i.e., before, after, or concurrently with the composite liner sections B–E. It is apparent that the combustion chamber liner section A is formed by laying fire brick against and entirely around the interior surface of the kiln wall 13 for a desired length of the combustion chamber, and each fire barrier wall 65 is formed of refractory material cast against and around the interior surface of the kiln wall 13.

For the purpose of describing the method of the present invention, it will be assumed that the refractory brick layer 27 of the combustion chamber liner section A has been constructed against the kiln wall 13 and that the first of the fire barrier walls 65 is to be cast of the refractory material during the casting of the refractory layer 50 of the first of the annular composite liner sections B. Thus, the section B is built along the interior surface of the wall 13 of the kiln 12 by first constructing a segment of the respective annular liner section by forming an elongate relatively narrow layer of insulation material abutting the inner end of the combustion chamber layer 27 of brick and positioned against a generally lower region of the kiln wall interior surface by arranging a group of the insulating blocks 31 in a number of side-by-side elongate rows.

Figure 7:
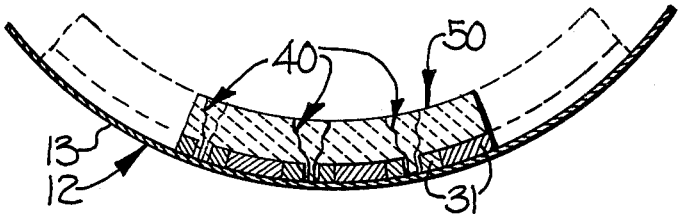
FIG. 7 is a fragmentary transverse vertical sectional view illustrating how successive segments of a composite annular liner section of the present invention may be constructed within the cylindrical metal kiln wall.

The manner in which a segment of the annular composite liner section may be formed is illustrated in the central portion of FIG. 7 and in FIGS. 8 and 9, wherein it will be observed that the segment there shown includes six longitudinally extending rows of the insulating blocks 31, for example, extending between the refractory brick layer 27 of the combustion chamber liner section A and the next adjacent fire barrier wall 65. The thermal insulating blocks 31 forming the segment of the composite liner section are positioned against the interior surface of the cylindrical metal kiln wall 13 and are oriented so that portions of the kiln wall are visible through the openings 32 in the blocks. The length of the liner section, and thus the length of the rows of insulating blocks 31 in each segment being constructed may be about thirty to fifty feet (9.144 to 15.24 meters). A convenient way of establishing the desired length of a composite liner section is by determining the length of liner section that a group of artisans can build in a normal workday of about eight hours time. Thus, it can be seen that a rotary kiln about one hundred sixty-five feet (60.29 meters) long, such as the prototype rotary kiln heretofore described, may include a series of three or four of the composite annular liner sections in addition to the combustion chamber liner section A of FIG. 4.

After the desired number of longitudinal rows of thermal insulating blocks 31 have been laid on the lower portion of the kiln wall 13 for forming a segment of the insulation material layer 30, inner end portions 41, 42 of anchor brackets 40 are secured, as by welding, to portions of the metal wall 13 of the kiln 12 visible through the openings 32 in the corresponding insulating blocks 31 and with outer arm portions 43 of the anchor brackets 40 projecting outwardly of the blocks (see FIG. 10). Thereafter, suitable mold forms 70 (FIGS. 8 and 9), such as boards, may be positioned against the distal longitudinal side edges of the two outermost rows of thermal insulating blocks 31, with the mold forms projecting above the plane of the rows of thermal insulating blocks 31 a distance equal to the desired thickness of the layer of refractory material 50, e.g., about six to eight inches (15.24 to 20.32 cm), to overlie the previously laid rows of thermal insulating blocks 31. Since the outer arm portions 43 of the anchor brackets 40 preferably project outwardly of the insulating blocks 31 to such extent that their outer portions 43 are exposed at the outer surface of the refractory material layer for presenting a more wear-resistant surface to the refractory material, it is apparent that the outer ends of the outer portions 43 of the anchor brackets 40 should also be located substantially the same distance above the insulating blocks 31 as that of the upper edges of the mold forms 70.

Thereafter, a corresponding segment of a layer 50 of the relatively hard cast refractory material is formed against the previously formed segment of the layer of insulation material 30 formed of the thermal insulating blocks 31 by casting a slurry of the refractory material against the segmental layer of insulation material, while at the same time, forming supporting columns 52 (FIG. 11) on the layer of refractory material by casting the same into and through the openings 32 in the segmental layer of insulation material, as shown in FIGS. 8 and 9. Thus, when the layer of refractory material hardens, the weight thereof will be largely, if not entirely, supported by the columns 52 to prevent crushing the underlying layer of thermal insulation material. It is to be noted that the refractory material on the segmental layer of insulation material of FIGS. 8 and 9 is also formed to a thickness substantially embedding the anchor brackets 40 in the refractory material for firmly anchoring the segments of both the layer of insulation material 30 and the layer of refractory material 50 to the kiln wall 13.

To aid in forming the adjacent fire barrier wall 65 integrally with the end of the refractory layer 50 of the liner section being formed, it will be observed in the left-hand portion of FIG. 8 that an additional, end mold form 71, of about the same effective height as mold forms 70, extends between and may be suitably secured to the mold forms 70. The additional mold form 71 is shown broken away to illustrate that it is spaced from the adjacent end of the segmental insulation material layer 30 to provide space into which the slurry of refractory material is molded to define the inner portion of a segment of the respective fire barrier wall 65 against the end of the insulation layer 30 and against the kiln wall 13. To complete formation of the respective fire barrier wall 65, the refractory material of the cast layer 50 is extended to the upper edge of the end mold form 71 so the barrier wall 65 is of a thickness about equal to the combined thickness of the layer of insulating blocks 31 and the overlying refractory material layer 50. The barrier wall 65 may be about four to six inches (10.16 to 15.24 cm) wide, for example.

Figure 2:
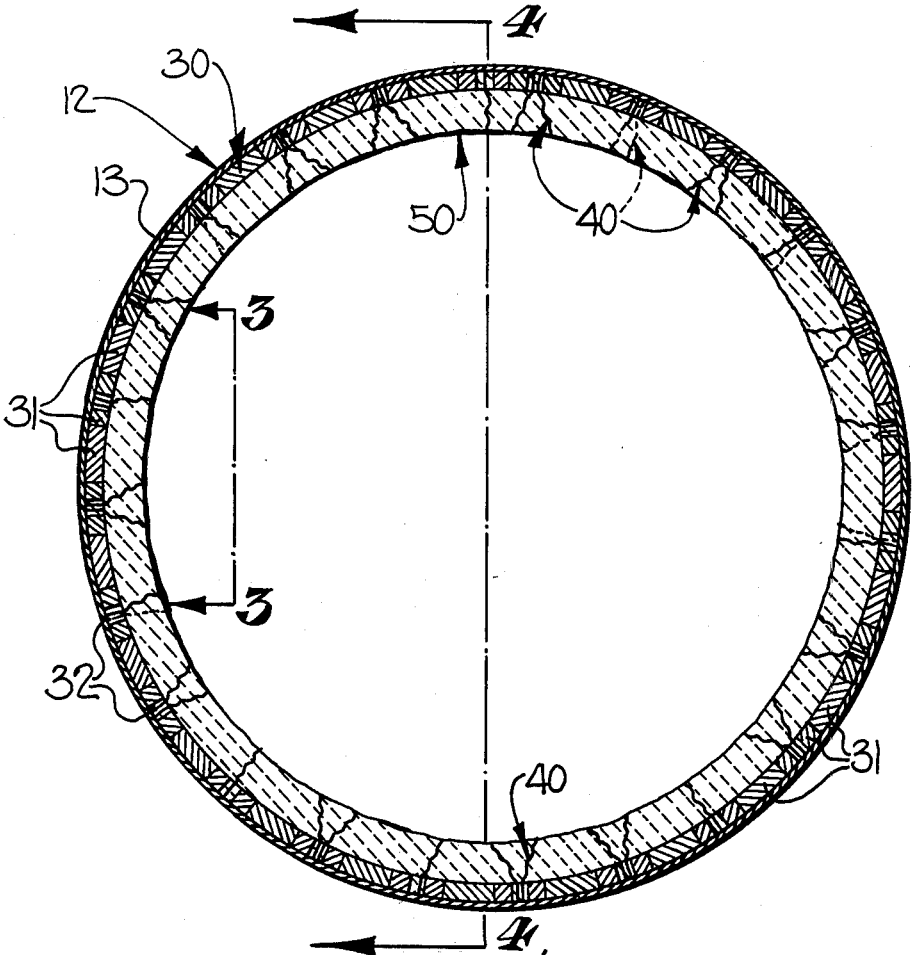
FIG. 2 is an enlarged transverse sectional view through the rotary kiln taken substantially along line 2—2 in FIG. 1.

After the segment of refractory material has hardened or set sufficiently so that it will at least retain its integrity during the performance of additional steps in the method, one or the other, or both, of the longitudinal mold forms 70 and the end mold form 71 may be removed from the thus formed segment of the liner section B and the respective fire barrier wall 65. Thereafter, as represented by the broken lines in FIG. 7, a plurality of additional side-by-side segments of the annular liner section are then built in succession and in substantially the same manner as that prescribed for the first segment illustrated in FIGS. 8 and 9, while the successive segments are being circularly arranged to complete the constructing of the annular composite liner section B and an adjacent fire barrier wall 65 on and around the interior surface of the cylindrical metal wall 13 of the kiln 12 as shown in FIGS. 2 and 4, for example. While the additional side-by-side segments of the annular liner section B and the respective fire barrier wall 65 are being constructed, the cylindrical wall 13 is rotated periodically to move successive segmental areas of the kiln wall 13 to a lower position for facilitating constructing of the successive segments of the annular liner section against the kiln wall 13.

It is apparent that essentially the same method steps as have been last described may be followed in constructing each of the composite liner sections B–E, and therefore, a further description thereof is deemed unnecessary. In this regard, it can be appreciated that the mold forms 70, 71 are removed from each liner section B–D upon completion thereof and may be reused in the construction of each succeeding composite liner section. However, the end mold form 71 need not be used in the construction of the endmost liner section E as the annular ridge 66 may be molded manually if desired, without the aid of an end mold form, such as the mold form 71 of FIG. 8.

Since the combustion chamber refractory brick liner section A is subject to the severe mechanical action and abrasion of the aggregate thereagainst during rotation of the rotary kiln 12, it is preferred that the refractory brick in the combustion chamber liner section A are positioned in tight abutting relationship without any mortar therebetween. In this regard, in actual construction of a layer of refractory brick 27 for the combustion chamber section A of the prototype rotary kiln, approximately a semicircular segment of the layer of refractory brick 27 was formed on the then lower portion of the kiln wall 13, after which suitable wooden braces, not shown, were placed in the combustion chamber portion of the kiln to support the then semicircular layer of refractory brick while the rotary kiln was subsequently rotated through an angle of about 180 degrees and the remaining half of the layer of refractory brick 27 then was formed. It is apparent that, since the refractory brick in combustion chamber liner section A are laid close together and/or they may be in the form of keystone-shaped brick, the integrity of the layer of refractory brick 27 is retained following subsequent removal of the aforementioned wooden braces from the annular layer of refractory brick 27.

It is thus seen that there is provided an improved thermal protective annular liner for the cylindrical metal wall of a rotary kiln and a method of making same, which liner is of long-wearing integral construction and serves to retain heat within the kiln so as to effect a substantial decrease in heat losses. In the apparatus heretofore described, for example, with the layers of insulating blocks 31 between the respective layers 50 of the refractory material and the metal kiln wall 13, a savings of about 80 percent or about 450,000 B.T.U. (British thermal units) was realized per ton of aggregate processed, as compared to the kiln when it was provided with only a refractory liner devoid of any thermal insulation material between the refractory material and the kiln wall.

In the drawings and specification, there has been set forth a preferred embodiment of the invention and, although specific terms are employed, they are used in a generic and descriptive sense and not for purposes of limitation, the scope of the invention being defined in the claims.

That which is claimed is:

1. In a rotary kiln for heat treating aggregate and having an elongate cylindrical metal kiln wall; the combination therewith of a wear-resistant thermal protective, annular liner extending around the interior surface of at least a substantial lengthwise portion of the kiln wall and comprising a plurality of elongate, annular liner sections, each liner section including a layer of thermal insulation material positioned against the interior surface of the kiln wall and including a plurality of contiguous lightweight thermal insulating blocks having openings through medial portions thereof extending generally perpendicular to the kiln wall so as to provide openings throughout said layer of insulation material, a layer of relatively hard cast refractory material overlying said layer of insulation material and having a plurality of spaced-apart column portions of the refractory material projecting inwardly from the refractory material layer and through the openings in said layer of thermal insulation material and positioned against the interior surface of said kiln wall so that the cast refractory material is essentially supported by said column portions thereof engaging said kiln wall, and anchor brackets secured to the interior surface of the kiln wall and projecting outwardly through said column portions and into said layer of cast refractory material so that said column portions are in surrounding relation to the respective anchor brackets and so that said anchor brackets reinforce said layer of refractory material and also firmly anchor both said layer of insulation material and said layer of refractory material to said kiln wall, and an annular fire barrier wall of refractory material disposed between and connecting adjacent iner sections and also being positioned against and extending around the interior surface of the kiln wall and projecting therefrom a distance about equal to the combined thickness of said layers of said insulation material and refractory material of each of said liner sections.

2. A rotary kiln according to claim 1 wherein each thermal insulating block is of elongate rectangular shape and has a plurality of said openings therethrough, and wherein said thermal insulating blocks of each annular liner section are arranged in side-by-side rows extending longitudinally of said kiln wall, and said insulating blocks are positioned in substantially abutting end-to-end relation in each row.

3. A rotary kiln according to claim 2 wherein said openings in certain of said thermal insulating blocks are staggered relative to those openings in other adjacent blocks.

4. A rotary kiln according to claim 1 wherein said anchor brackets project outwardly beyond said blocks to such extent that their outer portions are exposed at the outer surface of said layer of refractory material of each respective annular liner section for presenting a more wear-resistant surface to the refractory material.

5. A rotary kiln according to claim 1 wherein each anchor bracket includes an inner end portion secured to the kiln wall and projecting outwardly through the respective opening in the respective insulating block, and a pair of outwardly diverging arms integral with and projecting generally outwardly from said inner end portion of the respective anchor bracket.

6. A rotary kiln according to claim 5 wherein said arms on adjacent anchor brackets are randomly oriented.

7. A rotary kiln according to claim 5 wherein said outwardly diverging arms on each of said anchor brackets are each of an elongate serpentine configuration.

8. In a rotary kiln for heat treating aggregate and having an elongate cylindrical metal kiln wall; the combination therewith of a wear-resistant thermal protective, annular liner extending around the interior surface of the kiln wall and including an elongate annular liner section defining a combustion chamber adjacent one end of said cylindrical metal kiln wall and comprising an annular layer of refractory brick positioned against and extending around the interior surface of the kiln wall, and said annular liner further comprising a plurality of additional elongate annular liner sections arranged in series with respect to said first-named liner section, each additional liner section including a layer of thermal insulation material positioned against the interior surface of the kiln wall and including a plurality of contiguous lightweight thermal insulating blocks having openings through medial portions thereof extending generally perpendicular to the kiln wall so as to provide openings throughout said layer of insulation material, a layer of relatively hard cast refractory material overlying said layer of insulation material and having a plurality of spaced-apart column portions of the refractory material projecting inwardly from the refractory material layer and through the openings in said layer of thermal insulation material and positioned against the interior surface of said kiln wall so that the cast refractory material is essentially supported by said column portions thereof engaging said kiln wall, and anchor brackets secured to the interior surface of the kiln wall and projecting outwardly through said column portions and into said layer of cast refractory material so that said column portions are in surrounding relation to the respective anchor brackets and so that said anchor brackets reinforce said layer of refractory material and also firmly anchor both said layer of insulation material and said layer of refractory material to said kiln wall, and an annular fire barrier wall of refractory material positioned against and extending around the interior surace of said kiln wall and projecting therefrom a distance about equal to the combined thickness of said layers of insulation material and refractory material of each of said additional liner sections, with said fire barrier wall being disposed between and connecting adjacent ones of said additional liner sections, and the proximal ends of said annular layer of refractory brick of said combustion chamber and the next adjacent of said additional annular liner sections being positioned in substantially abutting relation with said layer of refractory brick of said combustion chamber projecting from the kiln wall a distance about equal to the combined thickness of the adjacent layers of said insulation material and refractory material of said adjacent additional annular liner section.

9. In a rotary kiln for heat treating aggregate and having an elongate cylindrical metal kiln wall; the combination therewith of a wear-resistant thermal protective, annular liner extending around the interior surface of at least a substantial lengthwise portion of the kiln wall and comprising a layer of thermal insulation material positioned against the interior surface of the kiln wall and including a plurality of contiguous lightweight thermal insulating blocks having openings through medial portions thereof extending generally perpendicular to the kiln wall so as to provide openings throughout said layer of insulation material, a layer of relatively hard cast refractory material overlying said layer of insulation material and having a plurality of spaced-apart column portions of the refractory material projecting inwardly from the refractory material layer and through the openings in said thermal insulation material layer and positioned against the interior surface of said kiln wall so that the cast refractory material is essentially supported by said column portions thereof engaging said kiln wall, and anchor brackets secured to the interior surface of the kiln wall and projecting outwardly through said column portions and into said refractory material layer so that said column portions are in surrounding relation to the respective anchor brackets and so that said anchor brackets reinforce said refractory material layer and also firmly anchor both said insulation material layer and said refractory material layer to said kiln wall.

10. A rotary kiln according to claim 9 wherein each thermal insulating block is of elongate rectangular shape and has a plurality of said openings therethrough, and wherein said blocks are arranged in side-by-side longitudinally extending rows, and the blocks in each row are positioned in substantially abutting end-to-end relationship.

11. A rotary kiln according to claim 10 wherein said openings in certain of said thermal insulating blocks are staggered relative to those openings in other adjacent insulating blocks.

12. A rotary kiln according to claim 9 wherein said anchor brackets project outwardly of said insulating blocks to such extent that their outer portions are exposed at the outer surface of said refractory material layer for presenting a more wear-resistant surface to said refractory material.

13. A rotary kiln according to claim 9 wherein each anchor bracket includes an inner end portion secured to the kiln wall and projecting outwardly through the respective opening in the respective insulating block, and a pair of outwardly diverging arms integral with and projecting generally outwardly from said inner end portion of the respective anchor bracket.

14. A rotary kiln according to claim 13 wherein said arms of adjacent anchor brackets are randomly oriented.

15. A rotary kiln according to claim 13 wherein said outwardly diverging arms on each of said anchor brackets are each of an elongate serpentine configuration.

16. A method of constructing a wear-resistant, thermal protective, annular liner on the interior surface of an elongate cylindrical metal wall of a rotary kiln of the type used for heat treating aggregate, said method comprising providing a plurality of lightweight, substantially rectangular thermal insulating blocks with openings through medial portions thereof, building a first annular section of the liner by the steps of forming a layer of the insulating blocks in contiguous relationship against the interior surface of the kiln metal wall with the blocks oriented so that portions of the kiln metal wall are visible through openings in the layer of insulating blocks, inserting end portions of anchor brackets through the openings in the layer of insulating blocks and securing such end portions to the kiln wall with outer arm portions of the anchor brackets projecting outwardly of the blocks, and forming a layer of refractory material against the thus formed layer of insulating blocks by casting a slurry of the refractory material against the layer of insulating blocks while forming supporting columns projecting inwardly from the layer of refractory material by casting the same into and through the openings in the layer of insulating blocks, and while forming the layer of refractory material to a thickness over the layer of insulating blocks substantially embedding the outer arm portions of the anchor brackets in the refractory material for firmly anchoring both the layer of insulating blocks and the layer of refractory material to the metal wall of the kiln, and forming a fire barrier wall of refractory material against and around the interior surface of the cylindrical kiln wall, while forming the fire barrier wall to a thickness projecting from the kiln wall about equal to the combined thickness of the layer of insulating blocks and the layer of refractory material of the annular liner section and while locating the fire barrier wall so that it connects to one end of the first annular section, and building a second annular section of the liner in essentially the same manner as prescribed for said first annular section and with the end of said second annular liner section adjacent the first annular liner section being in abutting relation to the fire barrier wall.

17. A method according to claim 16 which includes casting the fire barrier wall of refractory material and of the same refractory material as that of the cast layer overlying the insulating blocks.

18. A method according to claim 16 wherein the forming of the layer of refractory material over the layer of insulating blocks to substantially embed the outer arm portions of the anchor brackets in the refractory material comprises leaving the outer ends of the outer arm portions exposed to enhance the wear-resistant nature of the layer of refractory material.

19. A method of constructing a wear-resistant, thermal protective, annular liner on the interior surface of an elongate cylindrical metal wall of a rotary kiln of the type used for heat treating aggregate, said method comprising forming an elongate annular liner section defining a combustion chamber adjacent one end of the cylindrical metal wall by laying fire brick against and entirely around the interior surface of the kiln wall for the desired length of the combustion chamber, providing a plurality of lightweight, substantially rectangular thermal insulating blocks with openings through medial portions thereof, building a first additional annular section of the liner by the steps of forming a layer of the insulating blocks in contiguous relationship against the interior surface of the kiln metal wall and abutting the inner end of the combustion chamber liner section with the blocks oriented so that portions of the kiln metal wall are visible through openings in the layer of insulating blocks, inserting end portions of anchor brackets through the openings in the layer of insulating blocks and securing such end portions to the kiln metal wall with outer arm portions of the anchor brackets projecting outwardly of the blocks, and forming a layer of refractory material against the thus formed layer of insulating blocks by casting a slurry of the refractory material against the layer of insulating blocks while forming supporting columns projecting inwardly from the refractory material layer by casting the refractory material into and through the openings in the layer of insulating blocks, and while forming the layer of refractory material to a thickness over the layer of insulating blocks substantially embedding the outer arm portions of the anchor brackets in the refractory material for firmly anchoring both the layer of insulating blocks and the layer of refractory material to the metal wall of the kiln, and forming an annular fire barrier wall of refractory material against and around the interior surface of the cylindrical metal kiln wall, while forming the fire barrier wall to a thickness projecting from the kiln wall about equal to the combined thickness of the layer of insulating blocks and the layer of refractory material of the first additional annular liner section and while locating the fire barrier wall so that it connects to that end of the first additional annular section remote from the combustion chamber liner section, and building a second additional annular section of the liner axially of and in essentially the same manner as prescribed for said first additional annular section and with the end of said second additional annular liner section adjacent the first additional annular liner section connecting to the side of the annular fire barrier wall remote from the first additional annular liner section.

20. A method of constructing a wear-resistant, thermal protective, annular liner on and around the interior surface of an elongate cylindrical metal wall of a generally horizontal rotary kiln of the type used for heat treating aggregate, said method comprising the steps of providing a plurality of lightweight substantially rectangular thermal insulating blocks with openings through medial portions thereof, building a first annular section of the liner along the interior surface of the wall of the kiln by the steps of (a) constructing a segment of the annular liner section by forming an elongate relatively narrow layer of insulation material against a generally lower region of the kiln wall interior surface by arranging a group of the insulating blocks in a number of side-by-side elongate rows with the blocks in abutting end-to-end relation in each row and the blocks oriented so that portions of the kiln wall are visible through the openings in the blocks, (b) securing inner end portions of anchor brackets to portions of the metal wall of the kiln visible through the openings in the blocks and with outer arm portions of the anchor brackets projecting outwardly of the blocks, and (c) forming a layer of refractory material against the thus formed layer of insulation material by casting a slurry of the refractory material against the layer of insulation material while forming supporting columns projecting inwardly from the layer of refractory material by casting the same into and through the openings in the layer of insulation material and while forming the refractory material on the layer of insulation material to a thickness substantially embedding the anchor brackets in the refractory material for firmly anchoring both the layer of insulation material and the layer of refractory material to the kiln wall, and then successively building a plurality of additional side-by-side segments of the annular liner section in substantially the same manner as that prescribed while circularly arranging the same to complete the constructing of the annular liner section on and around the cylindrical metal wall of the kiln, and while rotating said cylindrical wall periodically to move successive segmental areas of the kiln wall to a lower position for facilitating constructing of the successive segments of the annular liner section against the kiln wall, forming a fire barrier wall of refractory material against and around the interior surface of the cylindrical kiln wall, while forming the fire barrier wall to a thickness projecting from the kiln wall about equal to the combined thickness of the layers of insulation and refractory materials of the annular liner section and while locating the fire barrier wall so that it connects to one end of the first annular section, and building a second annular section of the liner in essentially the same manner as prescribed for said first annular section and so that the end of said second annular liner section adjacent the first annular liner section connects to the fire barrier wall.

21. A method of constructing a wear-resistant, thermal protective, annular liner on the interior surface of an elongate cylindrical metal wall of a rotary kiln of the type used for heat treating aggregate, said method comprising providing a plurality of lightweight, substantially rectangular thermal insulating blocks with openings through medial portions thereof, building at least one annular section of the liner by the steps of forming a layer of the insulating blocks in contiguous relationship against the interior surface of the kiln metal wall with the blocks oriented so that portions of the kiln metal wall are visible through openings in the layer of insulating blocks, inserting end portions of anchor brackets through the openings in the layer of insulating blocks and securing such end portions to the kiln wall with outer arm portions of the anchor brackets projecting outwardly of the blocks, and forming a layer of refractory material against the thus formed layer of insulating blocks by casting a slurry of the refractory material against the layer of insulating blocks while forming supporting columns projecting inwardly from the layer of refractory material by casting the same into and through the openings in the layer of insulating blocks, and while forming the layer of refractory material to a thickness over the layer of insulating blocks substantially embedding the outer arm portions of the anchor brackets in the refractory material for firmly anchoring both the layer of insulating blocks and the layer of refractory material to the metal wall of the kiln.

22. A method of constructing a wear-resistant, thermal protective, annular liner on and around the interior surface of an elongate cylindrical metal wall of a generally horizontal rotary kiln of the type used for heat treating aggregate, said method comprising the steps of providing a plurality of lightweight substantially rectangular thermal insulating blocks with openings through medial portions thereof, building an annular section of the liner along the interior surface of the wall of the kiln by the steps of (a) constructing a segment of the annular liner section by forming an elongate relatively narrow layer of insulation material against a generally lower region of the kiln wall interior surface by arranging a group of the insulating blocks in a number of side-by-side elongate rows with the blocks in abutting end-to-end relation in each row and the blocks oriented so that portions of the kiln wall are visible through the openings in the blocks, (b) securing inner end portions of anchor brackets to portions of the metal wall of the kiln visible through the openings in the blocks and with outer arm portions of the anchor brackets projecting outwardly of the blocks, and (c) forming a layer of refractory material against the thus formed layer of insulation material by casting a slurry of the refractory material against the layer of insulation material while forming supporting columns projecting inwardly from the layer of refractory material by casting the same into and through the openings in the layer of insulation material and while forming the refractory material on the layer of insulation material to a thickness substantially embedding the anchor brackets in the refractory material for firmly anchoring both the layer of insulation material and the layer of refractory material to the kiln wall, and then successively building a plurality of additional side-by-side segments of the annular liner section in substantially the same manner as that prescribed while circularly arranging the same to complete the constructing of the annular liner section on and around the cylindrical metal wall of the kiln, and while rotating said cylindrical wall periodically to move successive segmental areas of the kiln wall to a lower position for facilitating constructing of the successive segments of the annular liner section against the kiln wall.

* * * * *

UNITED STATES PATENT AND TRADEMARK OFFICE

CERTIFICATE OF CORRECTION

PATENT NO. : 4,289,479

DATED : September 15, 1981

INVENTOR(S) : Allen Starling Johnson, Jr.

It is certified that error appears in the above-identified patent and that said Letters Patent are hereby corrected as shown below:

Column 1, line 52 "iwardly" should be --inwardly--.

Column 11, line 2 "iner" should be --liner--.

Signed and Sealed this

*Fifth* Day of *January 1982*

[SEAL]

*Attest:*

GERALD J. MOSSINGHOFF

*Attesting Officer*

*Commissioner of Patents and Trademarks*